US009937543B2

(12) United States Patent
Patzelt et al.

(10) Patent No.: US 9,937,543 B2
(45) Date of Patent: Apr. 10, 2018

(54) DEVICE FOR WINDING A STRIP MATERIAL INTO A COIL

(71) Applicant: SMS Group GmbH, Duesseldorf (DE)

(72) Inventors: Ulrich Patzelt, Hilchenbach (DE); Benjamin Dickel, Bad Laasphe (DE)

(73) Assignee: SMS GROUP GMBH, Duesseldorf (DE)

( * ) Notice: Subject to any disclaimer, the term of this patent is extended or adjusted under 35 U.S.C. 154(b) by 115 days.

(21) Appl. No.: 15/025,644

(22) PCT Filed: Apr. 22, 2015

(86) PCT No.: PCT/EP2015/058665
§ 371 (c)(1),
(2) Date: Mar. 29, 2016

(87) PCT Pub. No.: WO2015/180894
PCT Pub. Date: Dec. 3, 2015

(65) Prior Publication Data

US 2016/0236251 A1 Aug. 18, 2016

(30) Foreign Application Priority Data

May 26, 2014 (DE) ..... 10 2014 210 036
May 26, 2014 (DE) ..... 10 2014 210 039
Jul. 1, 2014 (DE) ..... 10 2014 212 668

(51) Int. Cl.
*B21C 47/30* (2006.01)
*B65H 75/24* (2006.01)

(52) U.S. Cl.
CPC ..... *B21C 47/30* (2013.01); *B65H 75/242* (2013.01)

(58) Field of Classification Search
CPC ..... B21C 47/30; B65H 75/242
See application file for complete search history.

(56) References Cited

U.S. PATENT DOCUMENTS 2,202,563 A * 5/1940 Mikaelson ..... B21C 47/30 242/533.7
2,228,477 A * 1/1941 Nash ..... B21C 47/30 242/559.3
3,527,425 A * 9/1970 Shumaker ..... B21C 47/30 242/533

(Continued)

FOREIGN PATENT DOCUMENTS

CN 201353595 12/2009
DE 2723964 12/1978

(Continued)

*Primary Examiner* — Sang K Kim
(74) *Attorney, Agent, or Firm* — Ableman, Frayne & Schwab

(57) ABSTRACT

The invention relates to a device for winding a strip material into a coil. The device comprises a winding mandrel (1) having a shaft element (2) and radially movable segments (16) mounted on the shaft element for winding and unwinding the strip material. The device further comprises an actuating drive (26) for spreading or collapsing the segments. The device also has a rotary drive (5) for rotationally driving the winding mandrel. To achieve a simpler and more economical design, a displacement device (60) is provided for axially displacing the actuating drive (26) together with the winding mandrel (1).

7 Claims, 2 Drawing Sheets

(56) References Cited

U.S. PATENT DOCUMENTS

| | | | | |
|---|---|---|---|---|
| 4,572,453 | A | 2/1986 | Hirschmanner | |
| 4,728,051 | A * | 3/1988 | Rothenpieler | B21C 47/245 242/533.6 |
| 5,996,929 | A | 12/1999 | Mazodier | |
| 8,523,099 | B2 | 9/2013 | Kipping | |

FOREIGN PATENT DOCUMENTS

| | | |
|---|---|---|
| DE | 8806889 | 8/1988 |
| EP | 140872 | 5/1985 |
| EP | 1157757 | 11/2001 |
| JP | 56136744 | 10/1981 |
| JP | 5791824 | 6/1982 |
| JP | 62275954 | 11/1987 |
| JP | 01138019 | 5/1989 |
| SU | 925469 | 5/1982 |
| SU | 1037996 | 8/1983 |

* cited by examiner

DEVICE FOR WINDING A STRIP MATERIAL INTO A COIL

RELATED APPLICATIONS

This application is a National stage application of International application Serial No. PCT/EP2015/058665 filed Apr. 22, 2015 and which claims priority of German applications DE 102014210039.9 filed May 26, 2014, DE 102014210036.4 filed May 26, 2014 and DE102014212668.1 filed Jul. 1, 2014, all of the above-mentioned applications are incorporated herein by reference thereto.

BACKGROUND OF THE INVENTION

1. Field of the Invention

The invention relates to a device for winding a strip material into a coil and for unwinding the strip material. The device comprises a winding mandrel having a shaft element and radially displaceable segments mounted on the shaft element. An actuation drive and actuation elements so control the segments that they are displaceable radially further outwardly or further inwardly relative to the shaft element. The device further comprises a rotary drive for rotationally driving the winding mandrel, with the actuation drive and the rotary drive being arranged on opposite end sides of the winding mandrel.

2. Description of the Prior Art

Generic winding mandrels and devices are known from the state of the art. As a rule, conventional winding mandrels are formed of a driven winding shaft that has, in the region of the winding surface of the winding shaft, a segment gearing which can displace expanding segments which are carried by the winding mandrel, in a radial direction. A related expansion mechanism is arranged on the rotary drive side of the winding mandrel and has a shape mostly of an expansion cylinder. Upon a corresponding actuation of the expansion cylinder, the expansion cylinder alternatively acts, by means of continuous expansion shaft which extends in a hollow space of the winding shaft, on the expanding segments arranged on the winding surface, whereby a radial expansion of the winding surface or a radial collapse of the winding surface takes place. Here, one should distinguish between different functions, namely, expansion by drawing or pushing the expansion shaft in the axial direction of the winding mandrel or collapse or vice versa. The transmission of the driving power and thereby of the rotation to the winding shaft takes place on the rotary drive side of the winding mandrel between the drive unit and the winding shaft. The drive unit is generally a constructively complex combination of transmission gears, couplings, and motors. On the non-driving side of the winding mandrel, the non-driving side or the winding shaft is supported by a suitable thrust bearing or the like to compensate high torques and loads produced by reel tensions and/or coil weights. The expansion cylinder of the expansion mechanism and the drive unit of the rotationally driven winding mandrel are integrated in a gear box, so that removal of a wound coil takes place by drawing it on the operating side which is located opposite the driving side. In addition, in particular with an unwinding reel of a similar type, conventional coil centering and coil centering regulation in the equipment should be considered. Here, usually the entire gearing, together with the winding mandrel and the coil wound thereon, are displaced to compensate for winding offsets in the coil. In such a heavy construction, some components or groups of components, dependent on their function, should be made stronger. Also with a winding mandrel formed as a free console, load calculation should be taken into account, that is when the load torque entirely acts on the gear as a bearing point. Thereby, the torque load of the own weight of the winding mandrel up to its position in the gear continuously increases. In a winding operation, for design of the winding mandrel and its support in the gear, additionally, the coil weight and the reel tension should be taken into account. This cumulative load necessarily defines the limits and the drawbacks of the construction according to the state-of-the art, namely the support of the winding mandrel in the gear box should be very large and, as a result, the reel housing and the gear become very large. In addition, expensive and complicated means for rotational oil feeding should be made available.

In many known solutions with a continuous winding mandrel, a respective expansion mechanism is located at the drive side end of the winding mandrel and acts, indirectly, through the expanding shaft on the expanding segments. The necessity of the expansion shaft always leads to weakening of the cross-sections of the winding shaft that should bear the load of the coil weight and the reel tension. This is a drawback, because the technological lay out of the winding mandrel and, as a result, of the entire apparatus is significantly limited.

In order to avoid the above-mentioned drawbacks, there was proposed a further concept of the device for winding a strip material into a coil and that includes use of a double-expandable head reel. With this, the coil handling can be carried out in the line of the strip displacement. The logistic and technical advantage is obtained, however, at the cost of resulting technical and constructive drawbacks. E.g., in order to obtain a complete function of the device, all of the device components on both sides of the double-expandable head reel must be doubled. A smallest technical instability of both drives often leads to warping in the coil core which, in turn, often leads to a defective winding.

This technical drawback means that it is necessary, as a rule, to wind the strip onto a spool or to limit the strip thickness to thicker strips in order to limit the sensitivity. The winding mandrel designs, which are contemplated here essentially correspond to that of a continuous winding mandrel with all of the above-described drawbacks. Thereby, the flexibility and design possibilities of the device are smaller and, simultaneously, the equipment costs are increased. Auxiliary equipment such as, e.g., a spool handling system is absolutely necessary here.

Also, the idea behind the device concept involving the use of double-expandable head reel which consists in driving only one side of the double-expandable head reel, can be implemented only at small reel tensions which, e.g., happen during foil rolling. Already during rolling of thin strips, the reel tensions are so high that a two-side drive is necessary.

Generic continuous winding mandrels are described, e.g., in the following applications.

EP 1 157 757 discloses an expandable winding mandrel in which the expansion mechanism for expanding the winding mandrel is arranged at the winding mandrel drive side, wherein an expanding shaft extending from the expansion drive of the expansion mechanism, extends through a hollow shaft in order to be able to displace further radially outwardly or radially inwardly expanding elements mounted on the hollow shaft. In particular, the expansion drive is located on the winding mandrel drive side. As a result, the above-described drawbacks follow.

DE 698 00 408 T2 discloses an expandable winding mandrel for winding a strip-shaped stock in which an expansion drive, namely, a cylinder of the expansion mechanism is placed likewise on the winding mandrel drive side, so that also with this winding mandrel, the above-described drawbacks are brought to bear.

This also applies to a winding mandrel disclosed in DE 27 23 961 A1, wherein an expansion drive of an expansion mechanism is connected at the drive side end of the winding mandrel by flexible hose conduits to two blind bores in order to be able to displace hydraulically the expanding elements of the winding mandrel radially further outwardly or inwardly. However, the described winding mandrel is very expensive. In addition, the above-described drawbacks are also applied.

Further, JP 1 138 019 A (Abstract) describes a winding mandrel the expansion mechanism of which for expanding the expandable elements is likewise located on the winding mandrel drive side. Thus, the above-described drawbacks are also present.

The same applies to the winding mandrel described in JP 56-136 744A (Abstract) as there the expansion drive of the expansion mechanism for expanding the winding mandrel is also located on the winding mandrel drive side.

DE 698 00 408 T2 also discloses a winding mandrel for winding strip material with an expanding or collapsing mandrel in which a rotary drive of the winding mandrel and an actuation drive of the expandable and collapsible mandrel are located at the same end of the winding mandrel.

EP 0 140 872 A1 discloses a reel for winding sheet metal strips which includes a driven reel shaft and a hollow winding drum connected with the reel shaft, and wherein the winding drum includes an actuator-operated expansion mechanism with radially adjustable pressure elements projecting through through-openings in the winding drum. Alternatively, the actuator is arranged at a reel end opposite the rotary drive of the reel. However, the design of the reel, in particular, handling of a coil wound on the winding drum is relatively complicated.

DE 88 06 889 U1 discloses a winding device for a metallic flat strip material which includes a winding drum with expandable tension segments. The winding device includes a drive assembly with a drive shaft connectable with the winding drum so that exchange of the winding drum can be simplified.

The object of the invention is to so constructively improve the generic device that the above-mentioned drawbacks of the state-of-the art at least partially eliminated and the entire design is simplified.

SUMMARY OF THE INVENTION

This object is achieved by providing a displacement device for axially displacing the actuation drive, together with the winding mandrel.

Because the winding device includes a displacement device for axially displacing the actuation drive together with the winding mandrel, the winding mandrel can be disconnected from the usually stationary rotary drive. The possible axial displacement of the actuation drive, together with the winding mandrel provides for an advantageous, completely new concept of reel designs, e.g., rotary reels.

The term "winding" describes both winding of the strip material into a coil on an available winding mandrel and an unwinding of the coil from such a winding mandrel.

In this respect, the inventive winding mandrel can be used not only for winding a strip material into a coil at an outlet side of some rolling installation or the like, but also for unwinding a strip from a coil at an inlet side of a rolling installation and the like. Also, the present winding mandrel can be placed and used at different sites of a finishing installation and for different purposes.

The term "actuation drive" describes, within meaning of the invention, a device with which the segments can be displaced, with interposition of actuation elements. E.g., the actuation drive includes a hydraulic cylinder unit and/or an electric motor.

The term "actuation elements" describes, within meaning of the invention, components such as link elements between the actuation drive and the radially displaceable segments, which are also called (outer) flat elements.

It should be understood that the radially displaceable segments can be of varied designs. Advantageously, they are formed as elongate expanding elements, the longitudinal extension of which advantageously extends in the direction of the longitudinal axis of the winding mandrel.

The term "strip material", describes, within meaning of the invention different strip-like flat products which in the course of their manufacturing process are wound into a coil, bundle and the like. By the strip-like flat products, preferably, rolled strips from steel or non-ferrous metal are understood.

In comparison with the state-of-the art devices in which the actuation drive for the segments and the rotary drive for the shaft element, as a rule, are located on the same side of the winding mandrel, and the actuation mechanism for the segments should be displaced through the rotary drive or the associated gearing, the claimed complete spatial disconnection of the rotary drive and the actuation drive for the segments permits to substantially simplify the design of both drives. On the other hand, with a suitably designed displacement device, the construction of the winding mandrel can be significantly changed and simplified. This, on one hand, reduces costs and on the other hand, reduces maintenance expenses.

According to a first embodiment of the invention, the device has, in addition to a drive side thrust bearing, an actuation drive side thrust bearing for the winding mandrel. The advantage of this consists in that each of the two thrust bearings should be designed, with a predetermined or contemplated load, for about half of the total load. Also, the winding mandrel need not be designed as a free console, but rather as a stressed bending beam for a symmetrical two-side support. This simplifies the design and reduces costs. Alternatively, with preservation of a traditional stabilized design of the winding mandrel, the allowable load for the reel tension and coil weight can be noticeably greater because of the two-sided symmetrical load distribution.

The provision of a coupling device for the releasable connection of the shaft element of the winding mandrel with the rotary drive simplifies mounting and maintenance of the device and enables a spatial separation of the direct drive from the winding mandrel, on one hand, and from the actuation drive on the other hand. Advantageously, the coupling device is integrated into the rotary drive side thrust bearing or is formed as such.

The winding mandrel can be operationally connected, for its quick exchange, fixedly but releasably with the rotary drive by the coupling device. To this end, it makes sense to provide the shaft element, on its rotary drive end surface, with a rotary drive journal component with which the winding mandrel or the shaft element fixedly but releasably is connected with the output element of the mandrel drive.

It should be understood that the rotary drive journal can have different forms in order to be able to provide for a rapid releasable connection between the winding mandrel and the output element of the rotary drive. Constructively simple but effectively, the rotary drive journal element can be formed, e.g., as a spline journal or as a flat journal.

The claimed spatial disconnection of the rotary drive and the actuation drive for the segments enables an axial arrangement of the actuation drive, advantageously, immediately adjacent to the radially displaceable segments for direct control of the segments with actuation elements. This, advantageously, immediate vicinity of the actuation drive to the segments, with interposition of only of the actuation elements, provides, advantageously, not only for a simple but also for a particularly effective control of the segments. Effective and immediate control of the segments particularly results from a very short transmission path of forces or torques from the actuation drive to the segments.

The advantage of arrangement of the actuation drive adjacent to the radially displaceable segments consists in that the diameter of the winding mandrel can be selected independent from the construction of the actuation mechanism for the segments.

When the actuation elements are located outside of the shaft element, the shaft element need not any more necessarily be formed as a hollow shaft in order to at least partially receive the actuation elements. Alternatively, the shaft element can be formed as a solid body. The advantage of this consists in that with the same winding mandrel diameter, larger reel tensions, coil weights, and/or strip widths can be contemplated.

Advantageously, the actuation drive for segments is formed as hydraulic cylinder unit and/or as an electric motor.

DETAILED DESCRIPTION OF THE PREFERRED EMBODIMENT

Figure 1:
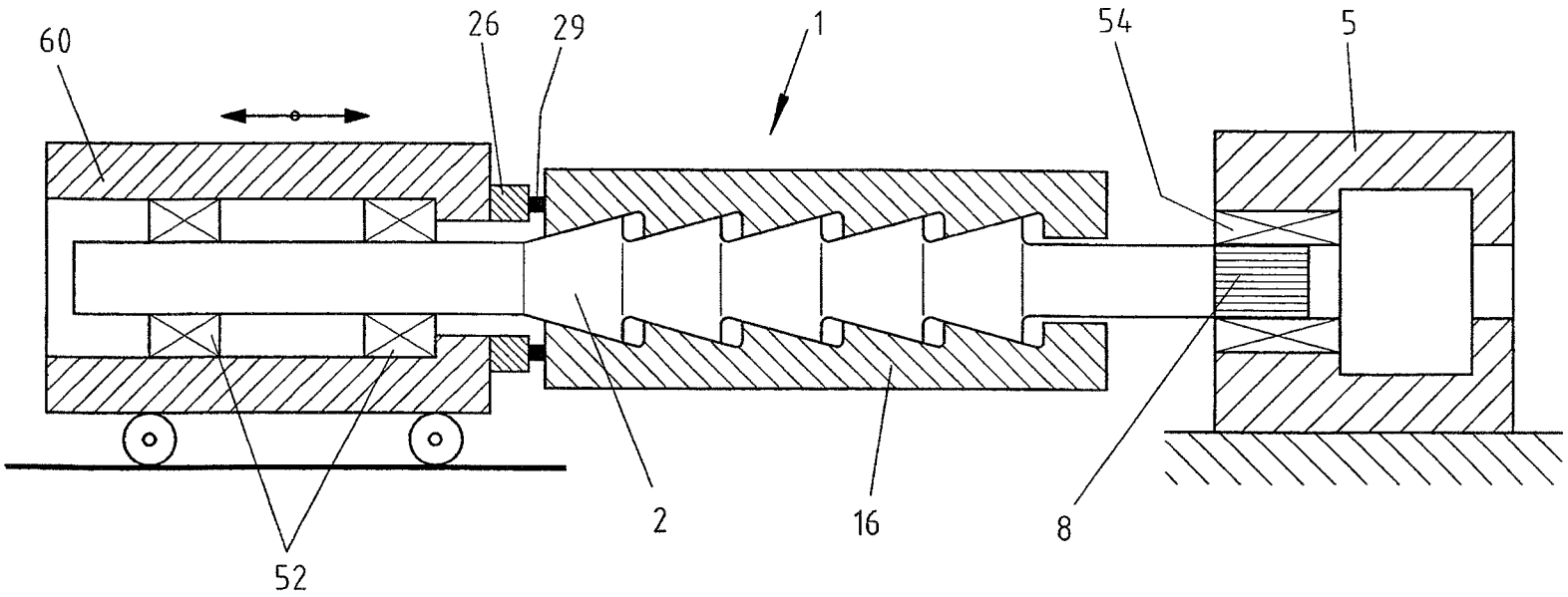
FIG. 1 a simplified cross-sectional view of the inventive device with a rolling drive side bearing formed as a spline bearing.
Figure 2:
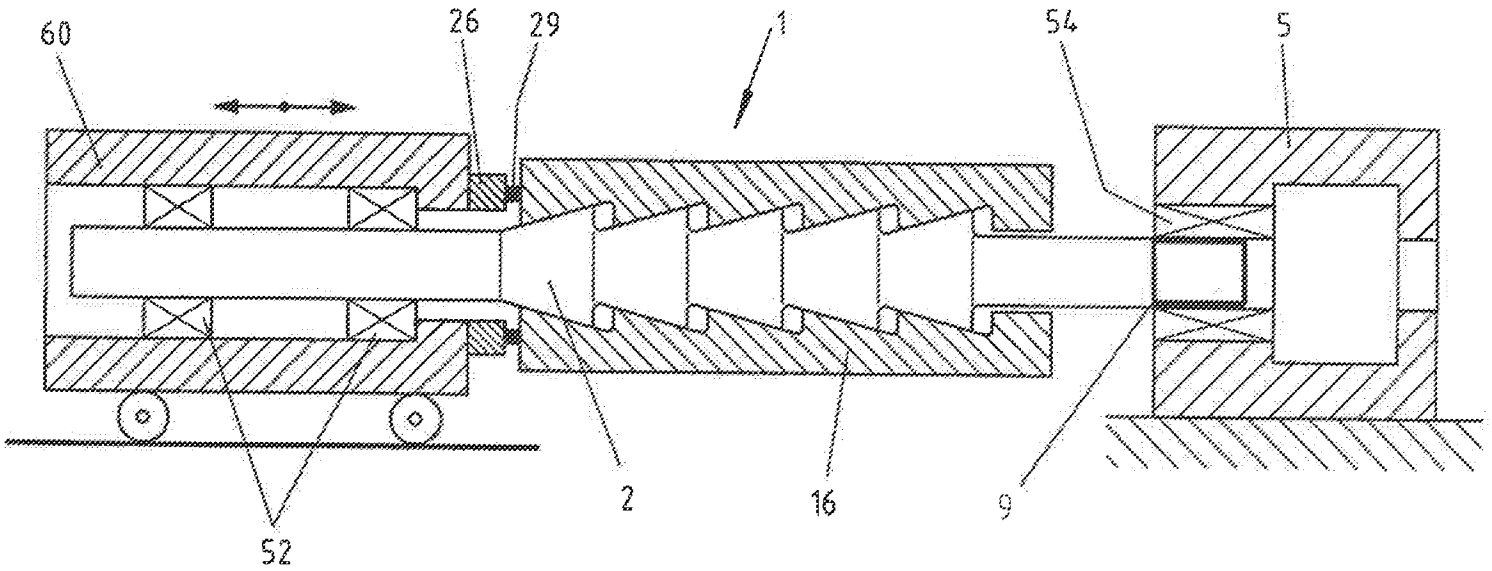
FIG. 2 a simplified cross-sectional view of the inventive device with a rolling drive side bearing formed as a flat bearing.

The subject matter of the invention will be further described in form of an exemplary embodiment with reference to FIG. 1.

FIG. 1 shows the inventive device for winding a strip material into a coil. To this end, the device includes a winding mandrel 1 having a shaft element 2 and radially displaceable segments 16 mounted on the shaft element. During the rotational movement of the winding mandrel, the strip material can be wound into a coil on the segments 16, or the strip material can be unwound from the coil.

The device further comprises an actuation drive 26 for displacing the segments 16 relative to the shaft element 2 with actuation elements 29. The displacement of the segments can consist in expansion of the segments, i.e., in a radial displacement of the segments further radially outwardly with respect to the shaft element or in collapsing of the segments, i.e., in displacement of the segments 16 further radially inwardly with respect to the shaft element 2.

Finally, the device has a rotary drive 5 for rotationally driving the winding mandrel 1. As shown in FIG. 1, the actuation drive 26 and the rotary drive 5 are arranged on opposite end sides of the winding mandrel 1.

As further shown in FIG. 1, the winding mandrel or, in particular its shaft element is supported on its opposite ends. To this end, a thrust bearing 52 and a thrust bearing 54 are provided on the actuation drive side and the rotary drive side, respectively. With a predetermined total load, both trust bearings should be advantageously designed for carrying, respectively, about a half of the total load. Also, the winding mandrel or the shaft element can be designed to be lighter than when it should be designed as a free console for the same predetermined total load.

The rotary drive is usually secured, together with a gearbox, stationary in the foundation. The rotary drive side thrust bearing 54 is preferably formed as a coupling bearing for releasably connecting or disconnecting the shaft element 2 to or from the rotary drive. For transmission of a rotary torque from the rotary drive to the shaft element 2, its rotary drive side journal, i.e., the rotary drive side journal section 8 is formed, e.g., as a flat journal 9, or with a square or polygonal cross-section.

As shown in FIG. 1, the actuation drive 26 is preferably axially arranged immediately adjacent to the radially displaceable segments. The advantage of this consists in that the segments can be directly controlled for radial displacement.

FIG. 1 further shows a displacement device 60 for displacing the winding mandrel 1, together with the actuation drive 26 and the actuation elements 29, in particular, in the axial direction, i.e., in the direction shown in FIG. 1 with a double arrow.

LIST OF REFERENCE NUMERALS

1 Winding mandrel
2 Shaft element
5 Rotary drive
8 Rotary drive journal section
16 Segment
26 Actuation drive
29 Actuation elements
52 Actuation drive side thrust bearing
54 Rotary drive side thrust bearing
60 Displacement drive

The invention claimed is:

1. A device for winding a strip material into a coil, comprising a single winding mandrel (1) having a shaft element (2) and radially displaceable segments (16) mounted on the shaft element (2) for winding the strip material onto the segments;

an actuation drive (26) for displacing the segments (16) relative to the shaft element (2) with actuation elements (29) either further radially outwardly or further radially inwardly; and a rotary device (5) for rotationally driving the single winding mandrel, wherein the actuation drive (26) and the rotary device (5) are arranged on axially opposite end sides of the single winding mandrel (1), wherein a displacement device (60) is provided for an axial displacement of the actuation drive (26) together with the single winding mandrel (1).

2. The device according to claim 1,
wherein
an actuation drive side thrust bearing and a rotary drive side thrust bearing (52, 54) are provided for axially and rotationally supporting the shaft element (2) at the both ends thereof.

3. The device according to claim 2, wherein the rolling drive side bearing (54) is formed as a coupling bearing for releasably connecting and disconnecting the shaft element (2) to and from the rotary drive (5).

4. The device according to claim 3, wherein the shaft element (2) has, on the side of the rotary drive (5), a rotary drive journal section (8) that fixedly but releasably connects the shaft element with an output shaft of the rotary drive (5).

5. The device according to claim 4, wherein the coupling bearing (54) is formed as a flat, or a spline bearing and journal bearing the rotary drive journal section (8) is formed as a flat journal or a spline journal cooperating with the flat journal bearing or the spline bearing.

6. The device according to claim 1, wherein the actuation drive (26) is axially arranged adjacent to the radially displacement segments (16) for directly controlling the segments (16) with the actuation elements (29).

7. The device according to claim 6, wherein the actuation drive (26) actuation elements (29) are interposed between and the radially displaceable segments (16).

* * * * *